US007361124B1

(12) United States Patent
Chung-Ting

(10) Patent No.: US 7,361,124 B1
(45) Date of Patent: Apr. 22, 2008

(54) ROWING MACHINE

(76) Inventor: Tseng Chung-Ting, P.O. Box 24-108, Taipei (TW)

( * ) Notice: Subject to any disclaimer, the term of this patent is extended or adjusted under 35 U.S.C. 154(b) by 0 days.

(21) Appl. No.: 11/698,236

(22) Filed: Jan. 26, 2007

(51) Int. Cl.
*A63B 69/06* (2006.01)
*A63B 21/015* (2006.01)

(52) U.S. Cl. ..... 482/72; 482/117

(58) Field of Classification Search ..... 482/72–73, 482/114–118, 57, 51, 908
See application file for complete search history.

(56) References Cited

U.S. PATENT DOCUMENTS 3,912,264 A * 10/1975 Busse et al. ..... 482/72
4,452,448 A * 6/1984 Ausherman ..... 482/114
4,563,000 A * 1/1986 Gall ..... 482/72
4,705,268 A * 11/1987 Nadeau ..... 482/72
4,723,774 A * 2/1988 Monforte ..... 482/72
4,762,317 A * 8/1988 Camfield et al. ..... 482/62
4,867,447 A * 9/1989 Johnson ..... 482/73
5,441,469 A * 8/1995 Chern ..... 482/72
5,980,435 A * 11/1999 Joutras et al. ..... 482/114
6,001,046 A * 12/1999 Chang ..... 482/57
7,022,052 B1 * 4/2006 Lai ..... 482/72
2007/0099770 A1 * 5/2007 Yang ..... 482/72

* cited by examiner

*Primary Examiner*—Fenn C. Mathew

(57) ABSTRACT

A rowing machine, which includes a machine base, which has two footrests arranged at the front side, a sliding track disposed at the top side, and two sidebars at two sides, two arm oars respectively pivoted to the side bars of the machine base through a respective universal joint, two adjustment screws mounted in the universal units for adjusting friction between a respective friction pad in each universal joint and the associating arm oars, and a sliding seat slidably mounted the sliding track for sitting by the player and lockable to the sliding track by an adjustment knob.

4 Claims, 4 Drawing Sheets

ROWING MACHINE

BACKGROUND OF THE INVENTION

1. Field of the Invention

The present invention relates to an exercising machine and more particularly, to a rowing machine, which permits the player to simulate actual rowing actions.

2. Description of the Related Art

Following improvement in living standards, people do more care about their health and in consequence, exercising apparatuses have become quite popular. Conventional rowing machines mainly permit back and forth movements to achieve physical exercises. However, such back and forth rowing exercises do not resemble actual rowing actions. Further, the monotonous back and forth rowing exercises of conventional rowing machines will make the user feel bored after a long period of use. U.S. Pat. No. 6,679,814 discloses an improved design of rower exerciser that permits the player to simulate actual rowing actions. However, this design of rower exerciser has a complicated structure, resulting in a high manufacturing cost.

SUMMARY OF THE INVENTION

The present invention has been accomplished under the circumstances in view. It is one object of the present invention to provide a rowing machine, which permits the player to simulate actual rowing actions. It is another object of the present invention to provide a rowing machine, which has a simple structure and is inexpensive to manufacture.

To achieve these and other objects of the present invention, the rowing machine comprises a machine base, which has two footrests arranged at a front side thereof, a sliding track disposed at a top side thereof, and two sidebars symmetrically arranged at two opposite lateral sides thereof, two universal joins respectively mounted on the side bars of the machine base, each universal joint having a friction pad, two arm oars respectively pivoted to the universal joints and disposed in contact with the friction pads in the universal joints, two adjustment screws respectively mounted in the universal joints for adjusting friction between the friction pads of the universal joints and the arm oars, a sliding seat mounted on and movable long the sliding track, and an adjustment knob controllable to lock the sliding seat to the sliding track.

DETAILED DESCRIPTION OF THE INVENTION

Figure 1:
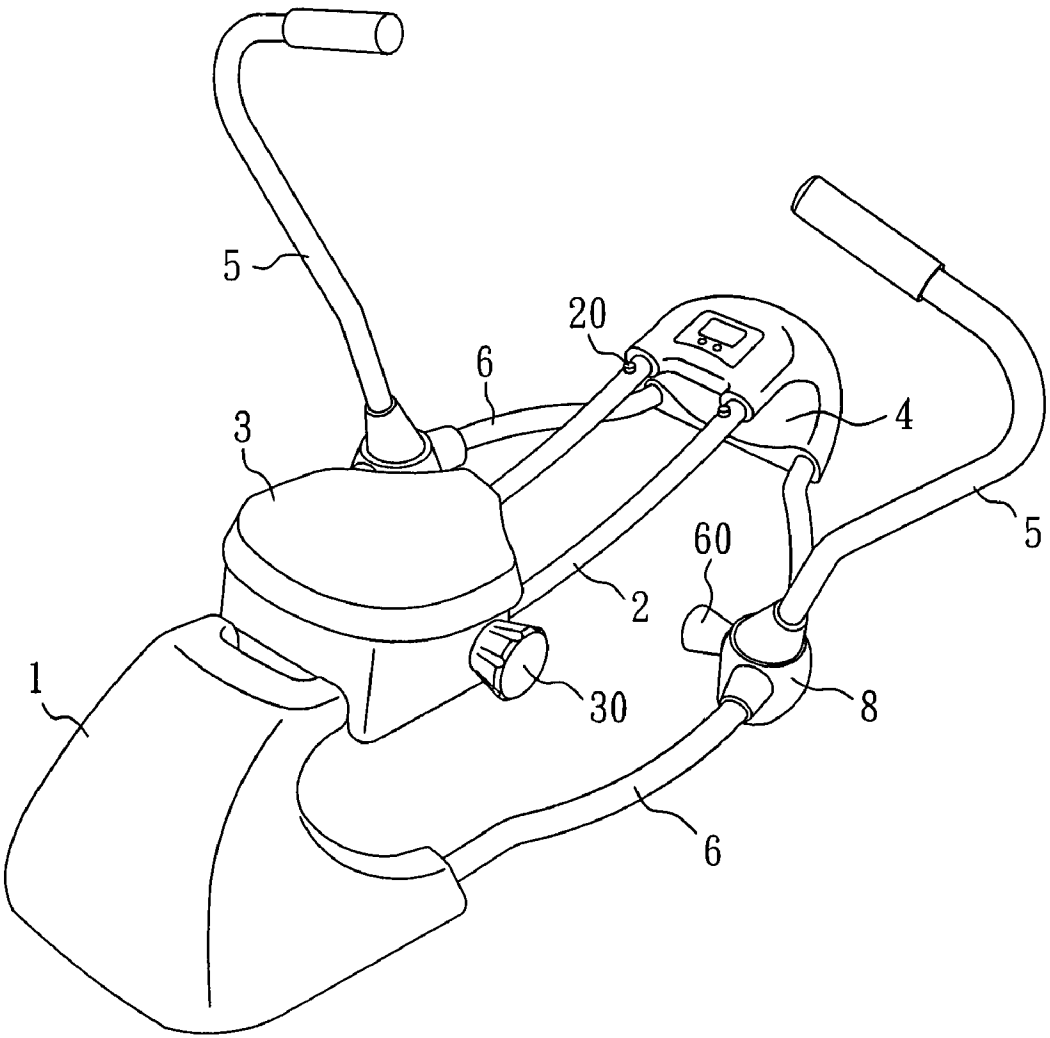
FIG. 1 is an elevational view of a rowing machine in accordance with the present invention.
Figure 2:
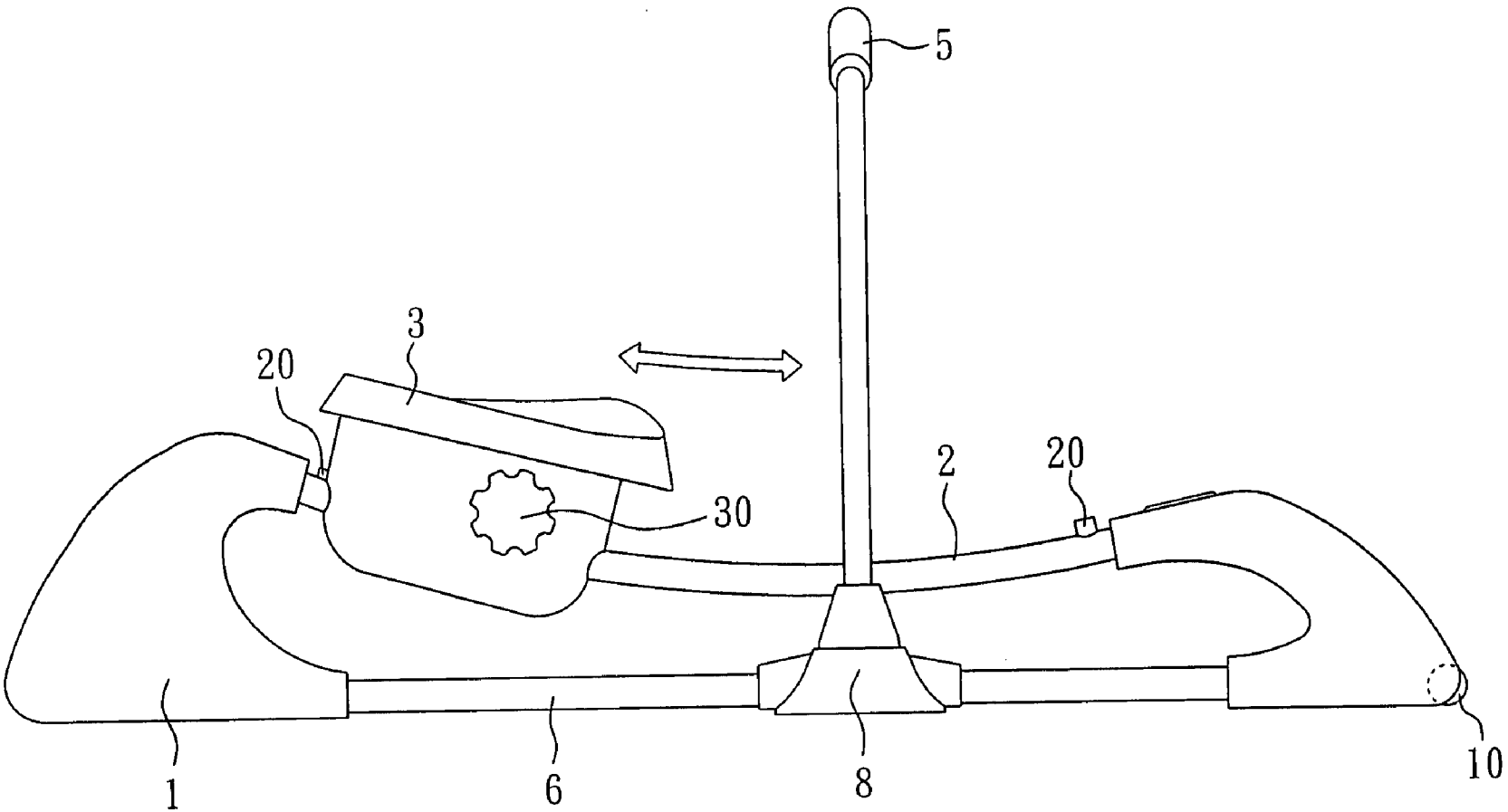
FIG. 2 is a schematic side view of the present invention, showing the rowing machine in action.
Figure 3:
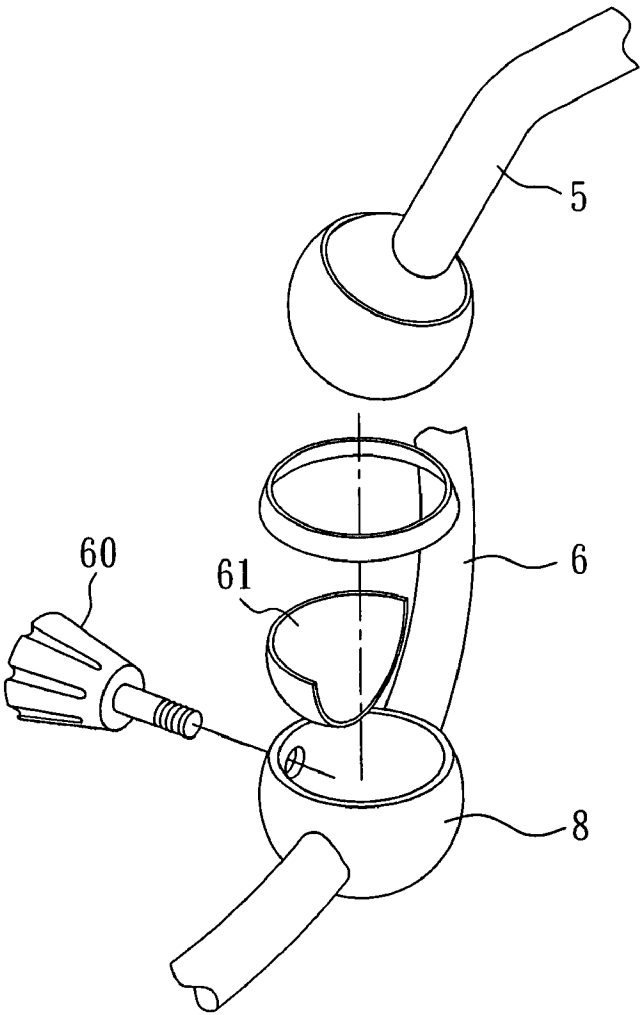
FIG. 3 is an exploded view of a part of the present invention, showing the structure of the universal joint.
Figure 4:
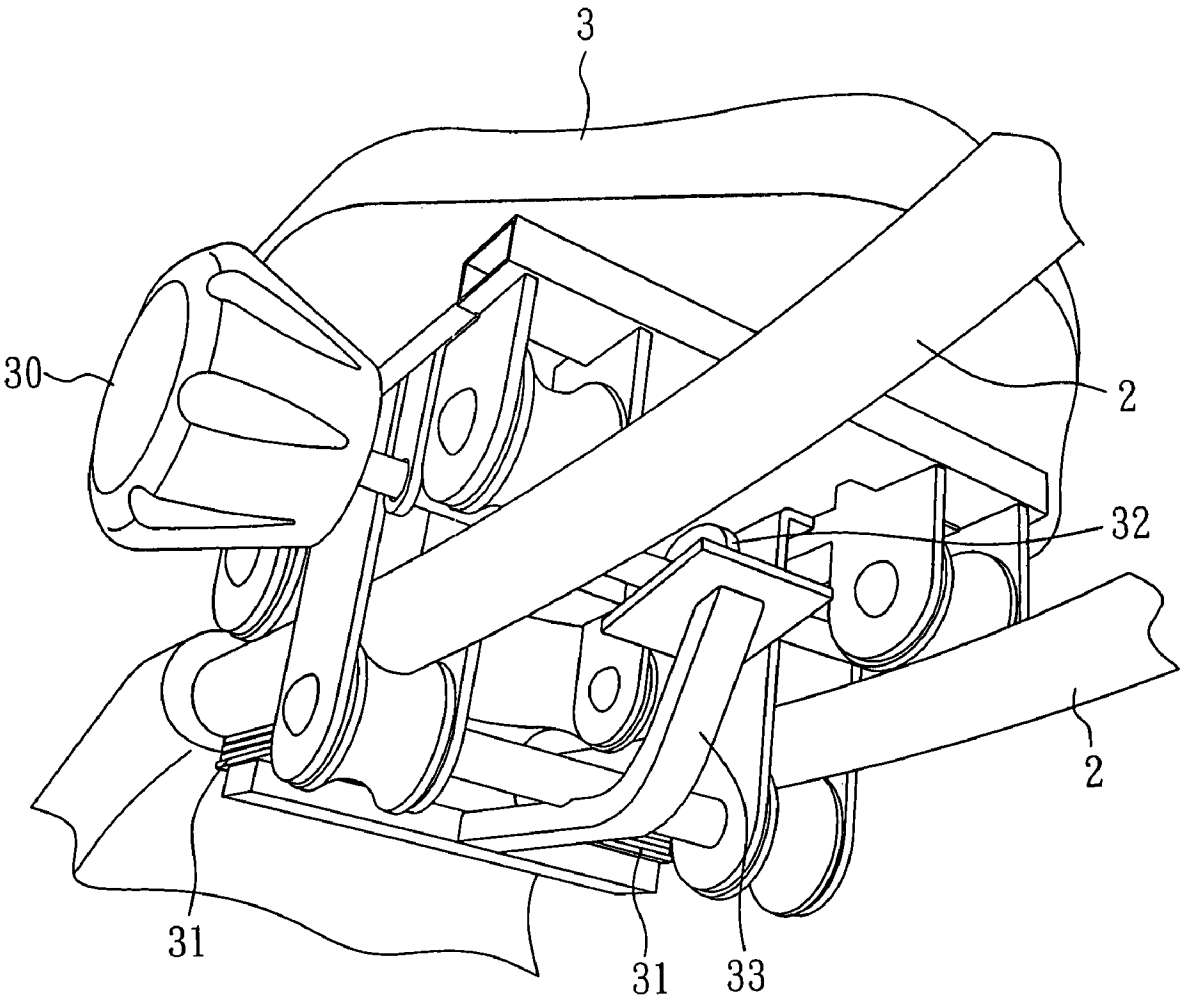
FIG. 4 is an elevational view in an enlarged scale of a part of FIG. 1, showing the structure of the sliding seat.

Referring to FIGS. 1~4, a rowing machine in accordance with the present invention is shown comprising a machine base 1, a sliding track 2, a sliding seat 3, and two arm oars 5.

The machine base 1 is molded from plastics and shaped like a boat, having two footrests 4 at the front side for the resting of the user's feet and two side bars 6 symmetrically disposed at two opposite lateral sides. The two arm oars 5 are respectively connected to the side bars 6 with a respective universal joint 8. Each universal joint 8 has a friction pad 61 mounted on the inside and disposed in friction contact with the associating arm oar 5, and an adjustment knob (for example, an adjustment screw) 60 for adjusting the friction force between the friction pad 61 and the associating arm oar 5. The sliding track 2 can be a single-rail, dual-rail, or multi-rail design. It is fixedly mounted on the machine base 1 at the top side, having bumper rubbers 20 at the two distal ends. The sliding seat 3 is mounted on the sliding track 2, and movable forwardly and backwardly along the sliding track 2 between its two distal ends. The sliding seat 3 is equipped with a friction pad 31 that is kept in close contact with the sliding track 2, an adjustment knob 30, and traction means 32 coupled between the friction pad 31 and the adjustment knob 30. The traction means 32 can be a link, cam, pull rope, or the like that allows adjustment of the friction force between the friction pad 31 and the sliding track 2 upon rotation of the adjustment knob 30. Further, rollers 10 are pivotally provided at the front and rear sides of the machine base 1 for easy movement of the rowing machine.

Referring to FIGS. 1 and 2 again, the user can operate the adjustment knobs 60 and 30 to adjust the friction force between the friction pads 61 of the universal joints 8 and the arm oars 5 and the friction force between the friction pads 31 of the sliding seat 3 and the sliding track before using the rowing machine. When fasten up the adjustment knob 30, the sliding seat 3 is locked to the sliding track 2. After adjustment, the user is sitting on the sliding seat 3 with the feet rested on the footrests 4 and the hands holding the arm oars 5, and then the user can push and pull the arm oars 5 to exercise the arms and the legs.

A prototype of rowing machine has been constructed with the features of FIGS. 1~4. The rowing machine functions smoothly to provide all of the features discussed earlier Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A rowing machine comprising:

a machine base to be placed on a floor, said machine base having two footrests arranged at a front side thereof, a sliding track disposed at a top side thereof, two sidebars symmetrically arranged at two opposite lateral sides thereof;

two universal joints respectively mounted on said side bars of said machine base, said universal joints each having a friction pad;

two arm oars respectively pivoted to said universal joints and disposed in contact with the friction pads in said universal joints;

two adjustment screws respectively mounted in said universal joints for adjusting friction between the friction pads of said universal joints and said arm oars; and a sliding seat mounted on and movable long said sliding track.

2. The rowing machine as claimed in claim 1, wherein said sliding seat comprises a friction pad facing said sliding track and attachable to said sliding track to produce a friction resistance, an adjustment knob, and means connected between the friction pad of said sliding seat and said adjustment knob and controllable by said adjustment knob to move the friction pad of said sliding seat relative to said sliding track.

3. The rowing machine as claimed in claim 1, wherein said sliding track has a plurality of bumper rubbers fixedly provided at two distal ends thereof for stopping said sliding seat.

4. The rowing machine as claimed in claim 1, wherein said machine base has front and rear sides thereof respectively provided with rollers.

* * * * *